US007178509B2

(12) United States Patent
Boos

(10) Patent No.: US 7,178,509 B2
(45) Date of Patent: Feb. 20, 2007

(54) HIGH-PRESSURE PUMP, IN PARTICULAR FOR A FUEL INJECTION SYSTEM OF AN INTERNAL COMBUSTION ENGINE

(75) Inventor: Burkhard Boos, Lambsborn (DE)

(73) Assignee: Robert Bosch GmbH (DE)

( * ) Notice: Subject to any disclaimer, the term of this patent is extended or adjusted under 35 U.S.C. 154(b) by 136 days.

(21) Appl. No.: 10/527,596

(22) PCT Filed: Jun. 20, 2003

(86) PCT No.: PCT/DE03/02061

§ 371 (c)(1),
(2), (4) Date: Mar. 14, 2005

(87) PCT Pub. No.: WO2004/033905

PCT Pub. Date: Apr. 22, 2004

(65) Prior Publication Data

US 2006/0008363 A1 Jan. 12, 2006

(30) Foreign Application Priority Data

Oct. 9, 2002 (DE) ..... 102 47 142

(51) Int. Cl.
*F02M 37/04* (2006.01)

(52) U.S. Cl. ..... 123/495; 417/273

(58) Field of Classification Search ..... 123/495, 123/450; 417/269, 273
See application file for complete search history.

(56) References Cited

U.S. PATENT DOCUMENTS 3,119,340 A * 1/1964 Scibbe ..... 74/837
5,701,872 A * 12/1997 Kaku et al. ..... 123/495
6,009,854 A * 1/2000 Rosgren et al. ..... 123/456
6,588,405 B1 7/2003 Streicher et al.

FOREIGN PATENT DOCUMENTS

DE 197 26 572 A1 12/1998
DE 198 02 476 A1 7/1999
EP 1 188 926 A2 3/2002

* cited by examiner

*Primary Examiner*—Thomas Moulis
(74) *Attorney, Agent, or Firm*—Ronald E. Greigg

(57) ABSTRACT

A high-pressure pump having a pump housing in which a plurality of pump elements are disposed, and by means of which fluid is pumped at high pressure via a high-pressure conduit system to a common high-pressure connection. The pump housing has a housing body and for each pump element one housing cap covering the pump element and joined to the housing body. The high-pressure conduit system has high-pressure bores extending without intersections in the housing body which bores are joined together in the region of the transition from the housing body to one of the housing caps, or in one of the housing caps, to form the common high-pressure connection.

18 Claims, 2 Drawing Sheets

HIGH-PRESSURE PUMP, IN PARTICULAR FOR A FUEL INJECTION SYSTEM OF AN INTERNAL COMBUSTION ENGINE

CROSS-REFERENCE TO RELATED APPLICATIONS

This application is a 35 USC 371 application of PCT/DE 03/02061 filed on Jun. 20, 2003.

BACKGROUND OF THE INVENTION

1. Field of the Invention

The invention is directed to an improved high-pressure pump, in particular for a fuel injection system for an internal combustion engine.

2. Description of the Prior Art

One high-pressure pump known from German Patent Disclosure DE 198 02 476 A1 has a pump housing in which a plurality of pump elements are disposed by means of which fuel is pumped via a high-pressure conduit system to a common high-pressure connection. The pump housing of the high-pressure pump is embodied in one piece, and the high-pressure conduit system has high-pressure bores, which extend through the pump housing and discharge into one another and thus form intersections. At high pressures, of the kind required for fuel injection systems for achieving high performance and low pollutant emissions in internal combustion engines, this puts high loads on the pump housing. The intersections of the high-pressure bores create peak stresses in the pump housing, and the pump housing must be designed in terms of dimensions and material to meet these peak stresses. This also requires a complicated hardening treatment of the pump housing. For these reasons, the production of the high-pressure pump is expensive.

SUMMARY AND ADVANTAGES OF THE INVENTION

The high-pressure pump of the invention has the advantage over the prior art that because of the absence of intersections, there is less stress on the housing body and it can thus be made from a less-expensive material and in a simpler way, making the production of the high-pressure pump overall less expensive. Typically, the housing caps do have bores with intersections and must therefore be made of material of suitable strength anyway, so that further intersections of the high-pressure bores that occur there do not involve increased expense.

Advantageous features and refinements of the high-pressure pump of the invention are disclosed.

BRIEF DESCRIPTION OF THE DRAWINGS

Other features and advantages of the invention will become apparent from the description contained herein below, taken with the drawings, in which.

DESCRIPTION OF THE PREFERRED EMBODIMENTS

Figure 1:
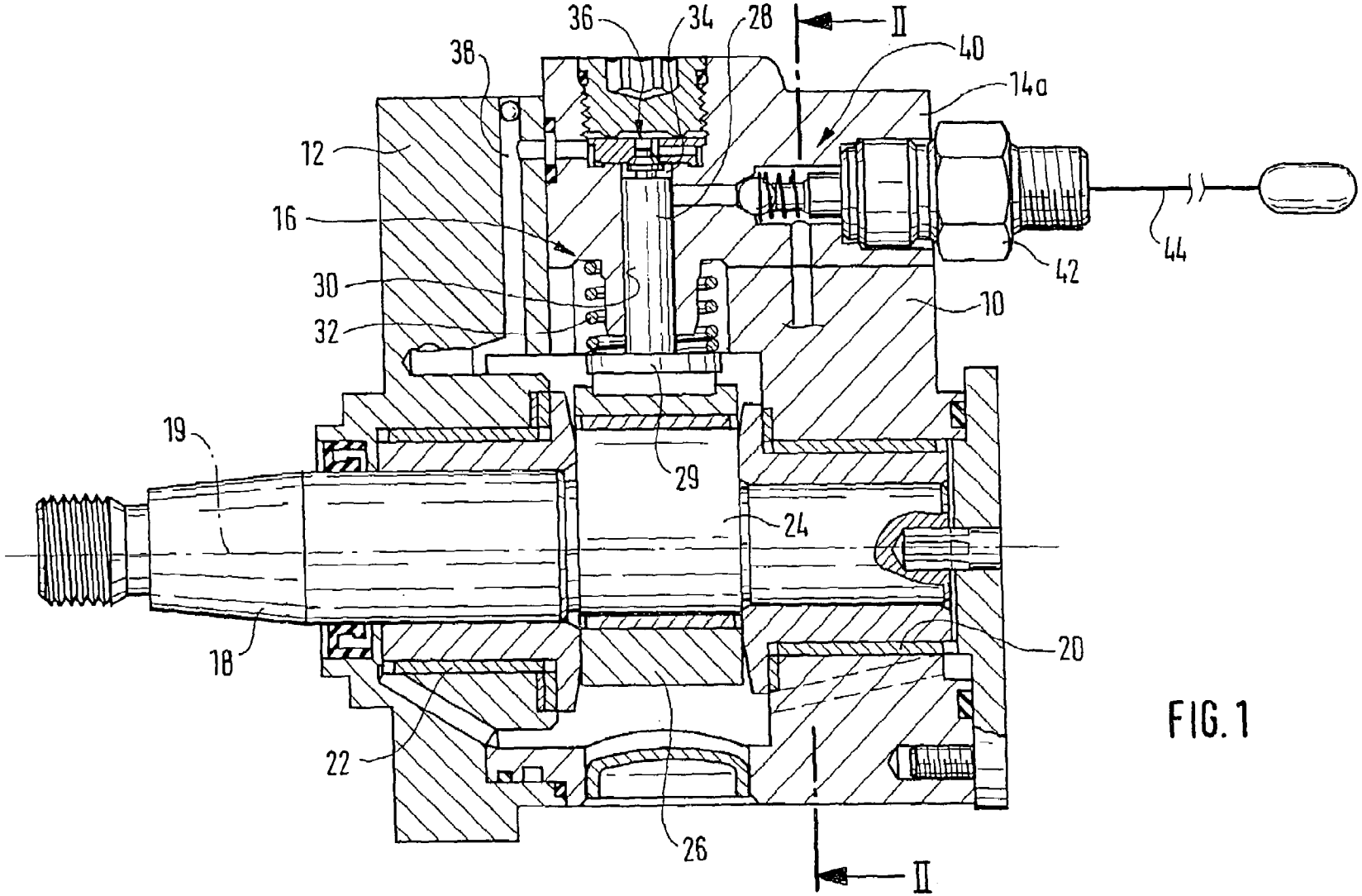
FIG. 1 shows a high-pressure pump in a longitudinal section.
Figure 2:
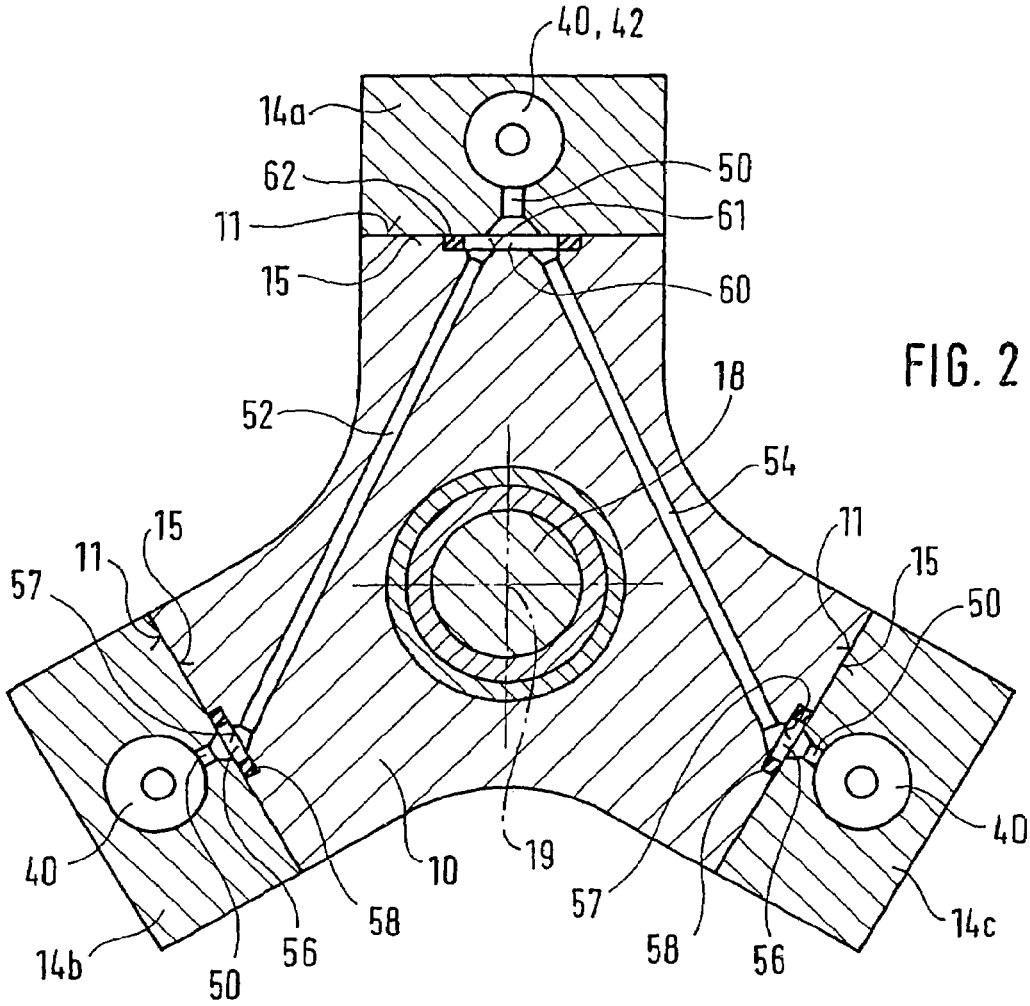
FIG. 2 shows the high-pressure pump in a cross section taken along the line II—II of FIG. 1 for a first exemplary embodiment.
Figure 3:
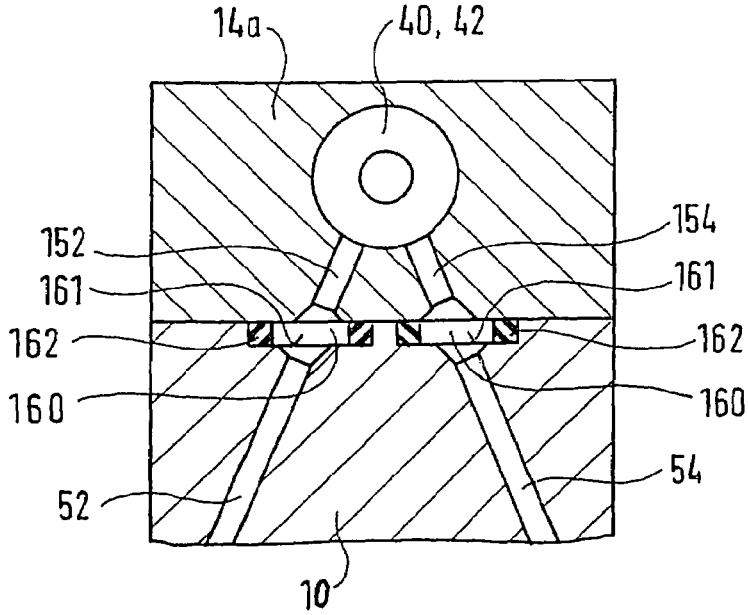
FIG. 3 shows the high-pressure pump in cross section in a second exemplary embodiment.

In FIGS. 1 through 3, a high-pressure pump is shown which is intended in particular for a fuel injection system for an internal combustion engine, for instance of a motor vehicle. By means of the high-pressure pump, fuel is pumped at high pressure of up to 2000 bar, for instance into a reservoir from which fuel is drawn for injection into the engine. The high-pressure pump has a multiple-part pump housing, which has a housing body 10, a flange part 12, and housing caps 14 that are joined to the housing body 10. A plurality of pump elements 16, for instance three, distributed uniformly over the circumference are disposed in the pump housing. A drive shaft 18 is rotatably supported in the housing body 10 and the flange part 12 and by means of it the pump elements 16 are driven. The drive shaft 18 is rotatably supported about an axis 19 via a bearing point 20 in the housing body 10 and via a bearing point 22 in the flange past 12 and is driven by the engine in a manner not shown. The drive shaft 18 has an eccentric portion 24, on which a reciprocating ring 26 is supported. The pump elements 16 each have one pump piston 28, which is guided tightly and displaceably in a cylinder bore 30 that extends at least approximately radially to the drive shaft 18. The cylinder bores 30 of the pump elements 16 may be embodied in either the housing body 10 or the housing caps 14. For each pump element 16, one housing cap 14 is provided, covering it from the outside radially relative to the pivot axis 19 of the drive shaft 18. The pump piston 28 of each pump element 16 is braced with its piston base 29 on the reciprocating ring 26, and the piston base 29 is kept in contact with the reciprocating ring 26 by a spring 32, which is braced on one end on the housing body 10 or the housing cap 14 and on the other on the piston base 29.

In the cylinder bore 30, the pump piston 28 of each pump element 16, with its face end, defines one pump work chamber 34 each. The pump work chamber 34 can be made to communicate, by an inlet valve 36 that opens into the pump work chamber 34, with a fuel inlet conduit 38 in which low pressure prevails. The pump work chamber 34 can moreover be made to communicate with the reservoir by means of an outlet valve 40, which opens toward the reservoir, via a high-pressure conduit system that extends in the housing body 10 and in the housing caps 14 and will be explained in further detail hereinafter. Upon rotation of the drive shaft 18, the pump pistons 28 are driven in a reciprocating motion via the eccentric portion 24 and the reciprocating ring 26. When the respective pump piston 28 moves radially inward, it executes an intake stroke; the respective inlet valve 36 is opened, causing fuel to flow via the fuel inlet conduit 38 into the respective pump work chamber 34, while the respective outlet valve 40 is closed. When the respective pump piston 28 moves radially outward, it executes a pumping stroke; the respective inlet valve 36 is closed, and the fuel compressed by the pump piston 28 flows through the opened outlet valve 40 at high pressure into the reservoir, via the high-pressure conduit system.

A high-pressure connection 42 is disposed on a housing cap 14*a*, and a high-pressure line 44 leading to the reservoir is connected to it. The fuel pumped by the pump elements 16 is carried via the high-pressure conduit system to the high-pressure connection 42 that is common to all the pump elements 16. The high-pressure connection 42 can be disposed with an arbitrary orientation on the housing cap 14*a*. The respective inlet valve 36 and/or and the respective outlet valve 40 of each pump element 16 can be disposed in the respective housing cap 14*a, b, c*.

The high-pressure conduit system in the housing body 10 and in the housing caps 14*a, b, c* will now be described in further detail in conjunction with FIG. 2. In the two housing caps 14*b, c,* on which the high-pressure connection 42 is not disposed, one bore 50 each adjoining the respective outlet valve 40 leads away to the housing body 10. The bores 50 extend at least approximately radially to the pivot axis 19 of the drive shaft 18. The orifices of the bores 50 may be widened in diameter, for instance being conical or spherical. The housing caps 14*a, b, c* and the housing body 10 have at least approximately level faces 11 and 15, respectively, oriented toward and resting on one another. High-pressure bores 52 and 54 extend in the housing body 10 and are connected to the respective bores 50 of the two housing caps 14*b, c* and lead to the housing cap 14*a* at which the common high-pressure connection 42 is disposed. In each of the faces 15 of the housing body 10 oriented toward the housing caps 14*b, c,* a respective indentation 56 is made, at whose at least approximately level bottom 57 the high-pressure bore 52 and 54, respectively, discharges. The orifice of each high-pressure bore 52 and 54 at the bottom 57 of the indentation 56 is preferably rounded. This can be done with a shaping drill, which can be positioned against the level bottom 57 of the indentation 56. Each of the indentations 56 has a larger cross section than the high-pressure bores 52, 54. A sealing ring 58 surrounding the high-pressure bores 52, 54 is inserted into each of the indentations 56, and by means of it the transition from the bore 50 in the housing cap 14*b, c* to the high-pressure bore 52 and 54, respectively, in the housing part 10 is sealed off.

In the first exemplary embodiment shown in FIG. 2, an indentation 60 which has an at least approximately level bottom 61 is made in the face 11 of the housing body 10 oriented toward the housing cap 14*a*. The two high-pressure bores 52 and 54 in the housing body 10 discharge into the indentation 60 with spacing from one another. The indentation 60 is thus embodied as larger in its cross section than the total of the diameters of the two high-pressure bores 52, 54. The orifice of the high-pressure bores 52, 54 at the bottom 61 of the indentation 60 is preferably rounded in each case, which in turn can be accomplished in a simple way by means of a shaping drill that can be positioned against the level bottom 61 of the indentation 60. A sealing ring 62 surrounding the high-pressure bores 52, 54 is inserted into the indentation 60. A bore 50 disposed at least approximately centrally to the indentation 60 is made in the housing cap 14*a* and leads to the common high-pressure connection 42. The bore 50 extends at least approximately radially to the pivot axis 19 of the drive shaft 18. The orifice, toward the indentation 60, of the bore 50 can be widened in diameter, for instance being conical or rounded. By means of the sealing ring 62, the transition from the high-pressure bores 52, 54 in the housing body 10 to the bore 50 in the housing cap 14*a* is sealed off. The bore 50 in the housing cap 14*a* and the outlet of the outlet valve 40 disposed in the housing cap 14*a* lead to the common high-pressure connection 42. The high-pressure bores 52, 54 extend without intersections in the housing body 10 and are joined together in the indentation 60, in the region of the transition from the housing body 10 to the housing cap 14*a*. This keeps the stress on the housing body 10 so slight that it can be produced from less expensive material with adequate strength and without any special hardening treatment, such as steel, or even of lightweight metal such as aluminum, if less pressure is generated by the pump elements 16. Alternatively, if a metal of high strength is used, as is necessary of the high-pressure bores have intersections, the pressure generated by the high-pressure pump can be increased and nevertheless adequate durability of the housing body 10 can be assured. The housing caps 14*a, b, c* have intersections at the transition from the outlet of the respective outlet valve 40 into the bore 50 and are produced from metal of suitably greater strength than that of the housing body 10, for instance being made from hardened steel.

In FIG. 3, the high-pressure pump is shown in a second exemplary embodiment, in which the construction is substantially identical to the first exemplary embodiment, so that only the distinguishing characteristics will be explained below. Two separate indentations 160 are made in the face 11 of the housing body 10 oriented toward the housing cap 14*a*, and one high-pressure bore 52 and 54, respectively, is made in each indentation 160. Each of the indentations 160 has an at least approximately level bottom 161, and the orifice of the respective high-pressure bore 52 and 54 in the respective indentation 160 is preferably rounded. Correspondingly, two bores 152, 154 are made in the housing cap 14*a* and extend the high-pressure bores 52, 54 as far as the common high-pressure connection 42. One sealing ring 162, surrounding the respective high-pressure bore 52 and 54 is inserted into each indentation 160, to seal off the transition from the housing body 10 to the housing cap 14*a*. In the second exemplary embodiment as well, the high-pressure bores 52, 54 thus extend in the housing body 10 without intersections, and intersections are present only in the housing cap 14*a*.

The foregoing relates to preferred exemplary embodiments of the invention, it being understood that other variants and embodiments thereof are possible within the spirit and scope of the invention, the latter being defined by the appended claims.

The invention claimed is:

1. A high-pressure pump for a fuel injection system of an internal combustion engine, the pump comprising, a pump housing (10, 12, 14)

a plurality of pump elements (16) disposed in the pump housing, the pump elements (16) being operable to pump fluid at high pressure via a high-pressure conduit system to a common high-pressure connection (42), the pump housing having a housing body (10) and, for each pump element (16), one housing cap (14) covering the pump element and joined to the housing body (10), and the high-pressure conduit system having high-pressure bores (52, 54) extending without intersections in the housing body (10), which bores are joined together in the region of the transition from the housing body (10) to one of the housing caps (14*a*) or in one of the housing caps (14*a*) to form the common high-pressure connection (42).

2. The high-pressure pump of claim 1, wherein the common high-pressure connection (42) is disposed on the housing cap (14*a*).

3. The high-pressure pump of claim 1, wherein the high-pressure bores (52, 54) are joined together in the region of the transition from the housing body (10) to the housing cap (14*a*) and discharge into an indentation (60), made in a face (11) of the housing body (10) that is oriented toward the housing cap (14*a*), from which indentation a single bore (50) leads onward in the housing cap (14*a*) to the common high-pressure connection (42).

4. The high-pressure pump of claim 2, wherein the high-pressure bores (52, 54) are joined together in the region of the transition from the housing body (10) to the housing cap (14*a*) and discharge into an indentation (60), made in a face (11) of the housing body (10) that is oriented toward the housing cap (14*a*), from which indentation a single bore (50) leads onward in the housing cap (14*a*) to the common high-pressure connection (42).

5. The high-pressure pump of claim 3, wherein the bottom (61) of the indentation (60) is embodied as at least approximately level; and wherein the orifices of the high-pressure bores (52, 54) at the bottom (61) of the indentation (60) are rounded.

6. The high-pressure pump of claim 4, wherein the bottom (61) of the indentation (60) is embodied as at least approximately level; and wherein the orifices of the high-pressure bores (52, 54) at the bottom (61) of the indentation (60) are rounded.

7. The high-pressure pump of claim 1, wherein the high-pressure bores (52, 54) each discharge into a respective indentation (160), made in a face (11) of the housing body (10) oriented toward the housing cap (14*a*); and wherein separate extensions (152, 154) of the high-pressure bores (52, 54) extend within the housing cap (14*a*) and are joined together in the housing cap (14*a*) to form the common high-pressure connection (42).

8. The high-pressure pump of claim 2, wherein the high-pressure bores (52, 54) each discharge into a respective indentation (160), made in a face (11) of the housing body (10) oriented toward the housing cap (14*a*); and wherein separate extensions (152, 154) of the high-pressure bores (52, 54) extend within the housing cap (14*a*) and are joined together in the housing cap (14*a*) to form the common high-pressure connection (42).

9. The high-pressure pump of claim 7, wherein the bottom (161) of the indentation (160) is embodied as at least approximately level; and wherein the orifices of the high-pressure bores (52, 54) at the bottom (161) of the indentation (160) are rounded.

10. The high-pressure pump of claim 8, wherein the bottom (161) of the indentation (160) is embodied as at least approximately level; and wherein the orifices of the high-pressure bores (52, 54) at the bottom (161) of the indentation (160) are rounded.

11. The high-pressure pump of claim 3, further comprising one sealing element (62; 162) each is inserted into the indentation (60) and the indentations (160), respectively, for sealing off the transition from the housing body (10) to the housing cap (14*a*).

12. The high-pressure pump of claim 4, further comprising one sealing element (62; 162) each is inserted into the indentation (60) and the indentations (160), respectively, for sealing off the transition from the housing body (10) to the housing cap (14*a*).

13. The high-pressure pump of claim 5, further comprising one sealing element (62; 162) each is inserted into the indentation (60) and the indentations (160), respectively, for sealing off the transition from the housing body (10) to the housing cap (14*a*).

14. The high-pressure pump of claim 6, further comprising one sealing element (62; 162) each is inserted into the indentation (60) and the indentations (160), respectively, for sealing off the transition from the housing body (10) to the housing cap (14*a*).

15. The high-pressure pump of claim 7, further comprising one sealing element (62; 162) each is inserted into the indentation (60) and the indentations (160), respectively, for sealing off the transition from the housing body (10) to the housing cap (14*a*).

16. The high-pressure pump of claim 8, further comprising one sealing element (62; 162) each is inserted into the indentation (60) and the indentations (160), respectively, for sealing off the transition from the housing body (10) to the housing cap (14*a*).

17. The high-pressure pump of claim 9, further comprising one sealing element (62; 162) each is inserted into the indentation (60) and the indentations (160), respectively, for sealing off the transition from the housing body (10) to the housing cap (14*a*).

18. The high-pressure pump of claim 1, wherein the housing body (10) and the housing cap are made of metal, and wherein the housing body (10) comprises a metal of lesser strength than the housing cap (14).

* * * * *